US010273056B2

(12) United States Patent
Hoffman et al.

(10) Patent No.: US 10,273,056 B2
(45) Date of Patent: Apr. 30, 2019

(54) FUEL CONTAINER SYSTEM

(71) Applicant: Hoffman Family Ventures, LLC, Berthoud, CO (US)

(72) Inventors: David Hoffman, Berthoud, CO (US); Misty Hoffman, Tacoma, WA (US)

(73) Assignee: Hoffman Family Ventures, LLC, Berthoud, CO (US)

( * ) Notice: Subject to any disclaimer, the term of this patent is extended or adjusted under 35 U.S.C. 154(b) by 0 days.

(21) Appl. No.: 15/636,799

(22) Filed: Jun. 29, 2017

(65) Prior Publication Data

US 2018/0002068 A1 Jan. 4, 2018

Related U.S. Application Data

(60) Provisional application No. 62/356,677, filed on Jun. 30, 2016.

(51) Int. Cl.

| | |
|---|---|
| ***B65D 6/32*** | (2006.01) |
| ***B65D 8/00*** | (2006.01) |
| ***B65D 25/46*** | (2006.01) |
| ***B65D 25/28*** | (2006.01) |
| ***B67D 7/38*** | (2010.01) |
| ***B67D 7/00*** | (2010.01) |
| ***B67D 7/04*** | (2010.01) |
| ***B65D 25/42*** | (2006.01) |

(52) U.S. Cl.

CPC ..... *B65D 25/465* (2013.01); *B65D 25/2826* (2013.01); *B65D 25/2894* (2013.01); *B65D 25/42* (2013.01); *B67D 7/005* (2013.01); *B67D 7/04* (2013.01); *B67D 7/38* (2013.01); *B65D 2231/008* (2013.01)

(58) Field of Classification Search

CPC ..... B65D 7/04; B65D 7/38; B65D 25/465; B65D 25/2894

USPC ..... 222/529, 530, 533, 534, 536, 537

See application file for complete search history.

(56) References Cited

U.S. PATENT DOCUMENTS 1,555,176 A * 9/1925 Allen ..... B65D 47/065 222/154
4,416,396 A * 11/1983 Ward ..... B60K 15/06 222/129
D358,330 S 5/1995 Kahl
(Continued)

FOREIGN PATENT DOCUMENTS

CA 2113406 7/1995

*Primary Examiner* — Vishal Pancholi
(74) *Attorney, Agent, or Firm* — University of Colorado Entrepreneurial Law Clinic

(57) ABSTRACT

The disclosure relates to a portable fuel container system which can facilitate extracting substantially all of the contents contained therein, without having to physically manipulate the container to do so, thereby minimizing spillage and waste. Embodiments of the fuel container system can include a fuel container enclosing a fluid cavity and a fluid dispenser. A collection channel may be recessed in the base section of the container and configured to gravitationally draw fluid to an end of the channel having an aperture, which forms a low point of the fluid cavity. A fluid dispenser can be coupled to the aperture and be in fluid communication with the cavity. The dispenser can include a valve and flexible conduit, allowing the user to position the dispenser to a desired location before activating the flow of fluid.

18 Claims, 11 Drawing Sheets

(56) References Cited

U.S. PATENT DOCUMENTS

| | | | | |
|---|---|---|---|---|
| 5,472,124 | A | 12/1995 | Martushev | |
| 5,597,097 | A | 1/1997 | Morris | |
| 5,850,949 | A | 12/1998 | Koerbel | |
| 6,068,163 | A | 5/2000 | Kihm | |
| 6,494,344 | B1 * | 12/2002 | Kressel, Sr. | B67D 7/04 222/157 |
| D608,855 | S | 1/2010 | Hatch et al. | |
| 7,802,704 | B2 | 9/2010 | Hatch | |
| 2006/0071039 | A1 * | 4/2006 | Bone | B65D 25/44 222/465.1 |
| 2012/0018460 | A1 * | 1/2012 | Slack | B65D 1/12 222/534 |
| 2012/0318829 | A1 | 12/2012 | Bonner | |
| 2013/0068800 | A1 * | 3/2013 | Ouderkirk | B67D 7/005 222/534 |

* cited by examiner

FUEL CONTAINER SYSTEM

CROSS REFERENCE

This application is a non-provisional application claiming the benefit of U.S. Provisional Application Ser. No. 62/356,677 filed on Jun. 30, 2016, which is incorporated by reference herein in its entirety for all purposes.

TECHNICAL FIELD

The present disclosure relates to portable fuel container systems comprising fluid containers and flexible dispensers.

BACKGROUND

Portable fuel containers are generally used to transport fuel from a fuel station pump to a device when it would be impractical or impossible to directly access the fuel station pump with the device. For example, one may desire to fill a lawn mower with fuel, but it would be very impractical or burdensome to bring the lawnmower to a gas station every time it needed to be refilled. On the other hand, portable fuel containers may be filled up at a gas station pump and then brought to the desired fuel engine. Likewise, portable fuel containers are useful for the temporary storage of fuel, such as when gasoline is siphoned from an automobile during maintenance or repair. In those circumstances, the fuel is transferred into the portable fuel container and may be dispensed into other equipment or returned to the original equipment after the required work is complete. Typical portable fuel containers are made from plastic with a capped opening for easily filling the container and storing fuel therein. These portable containers may have a separate spout for dispensing the fuel into the desired equipment. However, portable fuel containers are often susceptible to spilling when dispensing fuel as the result of imprecise human operation and the difficulty in handling heavy containers (e.g. when users tilt the containers to drain them). Additionally, it is typically difficult to empty all the fuel in conventional portable fuel containers, which can result in wasted fuel.

BRIEF SUMMARY

Among other things, embodiments provide a novel fuel container system. Embodiments of the fuel container system can provide a number of features such as facilitating dispensing of substantially all of the fuel (e.g., gasoline) from a portable fuel container system, while minimizing the spilling of fuel during the dispensing process and avoiding the need to physically tip, tilt, or otherwise pour fuel from the container. For example, some embodiments are implemented as a fuel container system having features that dispense fuel out of a fuel container through a flexible dispenser, such as a flexible hose, that may be maneuvered to the desired location before a valve is activated. When the valve is activated, fuel is allowed to flow directly from a fluid cavity within the fuel container through the flexible dispenser and into the desired vessel in a controlled manner. In these embodiments, the flexible dispenser can drain fuel from a collection channel that is formed in the base of the fuel container and positioned vertically lower relative to the rest of the fluid cavity of the container to permit collection of substantially all of the fuel in the container. Enclosing the fluid cavity in some embodiments, the fuel container may comprise a sidewall region, a top section having a sealable opening configured to receive fuel, and a base section located opposite the top section. The base section may contain a collection channel recessed with respect to the inner portion of the base section. The collection channel can be configured to gravitationally draw fuel toward a low end of the collection channel when the fuel container is in an upright position. In some cases, the low end of the collection channel may include an aperture for draining the contents of the fluid cavity.

According to one embodiment, a conduit passage extends from the aperture to the sidewall region. The conduit passage is recessed with respect to an outer portion of the base section, wherein the outer portion is facing away from the fluid cavity. A ground mount may support the base section when the fuel container is in the upright position, for example when placed on a substantially horizontal surface. In that configuration, the ground mount spaces the base section from the surface upon which the fuel container is placed.

Further, the fuel container may have a fluid dispenser. The fluid dispenser may comprise a flexible conduit fluidly coupled to the aperture at the low end of the collection channel, and at least a portion of the flexible conduit may be positioned within the conduit passage. The fluid dispenser may also have a valve, for instance a one-way valve, to control the flow of fuel through the flexible conduit. For example, the fuel may flow from the collection channel through the aperture into the flexible conduit and then out an outlet opening of the flexible conduit when the one-way valve is open.

BRIEF DESCRIPTION OF THE DRAWINGS

The accompanying figures illustrate one or more embodiments of the disclosed portable fuel container system, and together with the detailed description serve to explain the aspects and implementations of the system. Embodiments are described in conjunction with the appended figures.

DETAILED DESCRIPTION

Figure 1:
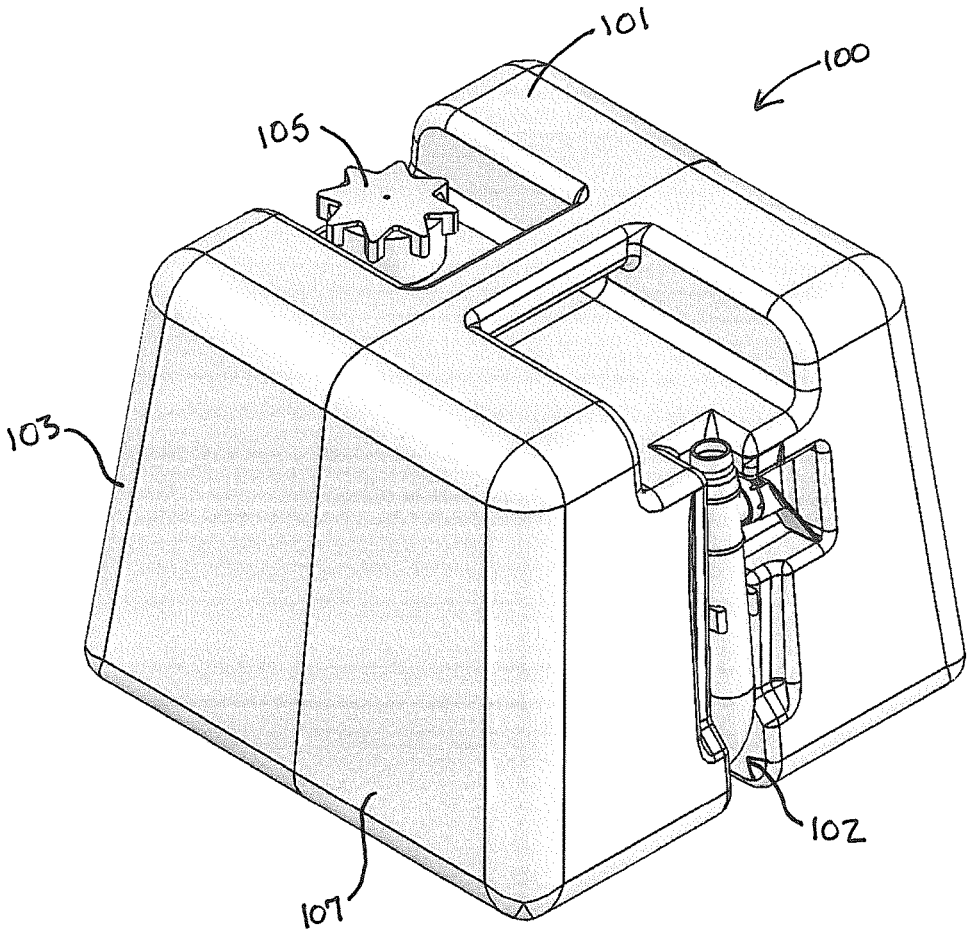
FIG. 1 shows a front top perspective view of a fuel container system with a fluid dispenser in a stored position.

All illustrations of the drawings are for the purpose of describing selected embodiments and are not intended to limit the scope of the claims. The following detailed description of the drawings, along with the preceding brief description of the drawings, utilizes a directional convention to promote clarity. Vertically descriptive terms, such as "top" and "bottom" or "up" and "down," relate to directions, locations, or view orientations of the fuel container system with respect to a gravitational frame of reference when the fuel container is resting upright on a horizontal surface. In the embodiments shown in the drawings, "front" of the fuel container of the fuel container system is the region, side, or point where the fluid dispenser interfaces with the fuel container. The "back" of the fuel container is the region, side, or point generally opposite the front. The "sides" of the fuel container correspond to the regions, sides, or points which are neither the front, back, top, nor bottom of the fuel container.

FIG. 1 shows one embodiment of a fuel container system 100 comprising a fuel container 103 oriented in an upright position. The fuel container 103 may be made from any suitable material depending on the contents to be stored therein. For example, plastic may be used for gasoline containers. In certain embodiments, the fuel container 103 may instead or additionally be made from metal. The fuel container 103 encloses a fluid cavity (shown in FIG. 4) which may be defined by a top section 101, a base section (shown in FIG. 4), and one or more sidewall regions 107. The fuel container system 100 has a fluid dispenser 102 connected to the base section of the fuel container 103 and configured for fluid communication with the fluid cavity. The fluid dispenser 102 is shown in FIG. 1 in a stored position, in which the fluid dispenser is secured in a fluid dispenser passage (shown in FIG. 3) formed on the sidewall region, thereby decreasing the overall physical imprint of the fuel container system 100.

Connecting the fluid dispenser 102 to the base section at a low point of the fluid cavity permits contents contained therein to be gravitationally drawn to the fluid dispenser 102, such that the fluid dispenser is able to drain substantially all of the fuel in the fuel container 103, thereby allowing drainage without needing to tilt or tip the container. In this way, the potential for spilling fuel from imprecise human operation of the container is minimized, and users do not manipulate the container in order to extract fuel which may be physically difficult or cumbersome, especially when the fluid cavity is full of fuel and the fuel container is at its heaviest. The fuel container system 100 may also have a sealable opening (shown in FIG. 3) on the top section 101 for introducing fuel into the fluid cavity, which opening is sealed with a removable cap 105 in one embodiment. The removable cap 105 may engage the sealable opening through various cap attachment and/or sealing mechanisms, such as complimentary screw threading on the sealable opening and removable cap 105.

At this point, it should be appreciated that the fuel container 103 may have different shapes in other embodiments, such as a substantially cylindrical form. In this configuration, the fuel container would have no specific front, back, or sides; the front, back, and sides could be any portion of the sidewall region of the fuel container. One skilled in the art would realize that the aspects of the fuel container system 100 described herein can be integrated using many different three-dimensional shapes, such as the cylindrical embodiment just disclosed.

Figure 2:
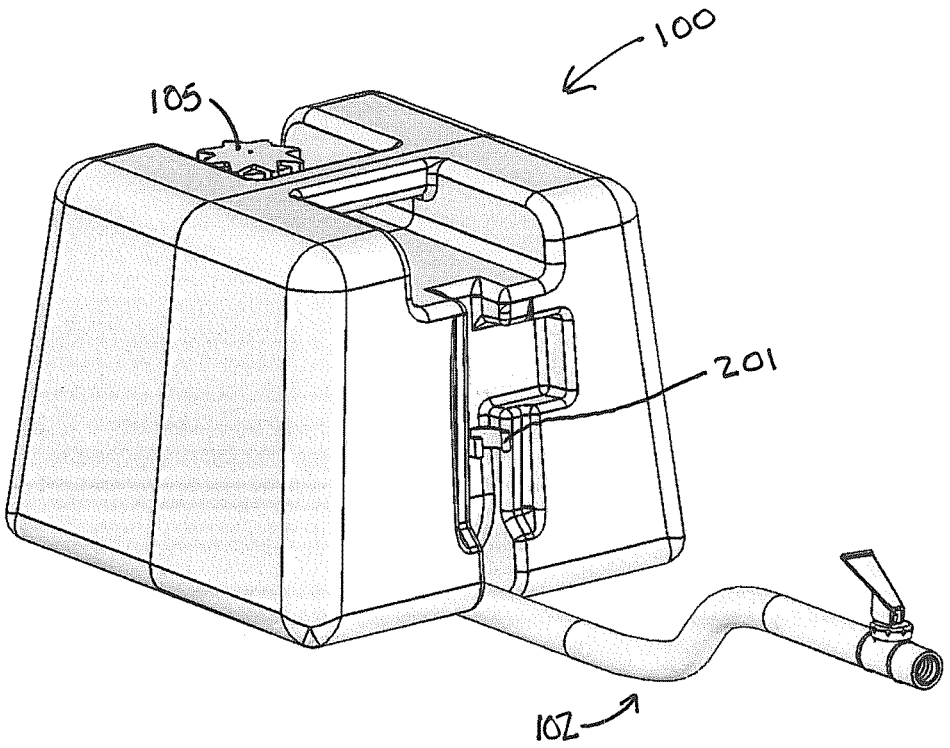
FIG. 2 shows a front top perspective view of the fuel container system of FIG. 1 with a fluid dispenser in a dispensing configuration.

FIG. 2 shows an embodiment of the fuel container system 100 in an upright position with the fluid dispenser 102 in a dispensing/utility configuration. In the stored position, the fluid dispenser 102 may be held in place by a dispenser clip 201. When a user desires to fill a piece of equipment (e.g, a car, lawnmower, and/or the like) with gasoline contained in the fluid cavity, the fluid dispenser 102 may be disengaged from the dispenser clip 201 and maneuvered to the desired location, thereby transitioning the fluid dispenser from its stored position to its dispensing configuration.

Figure 3:
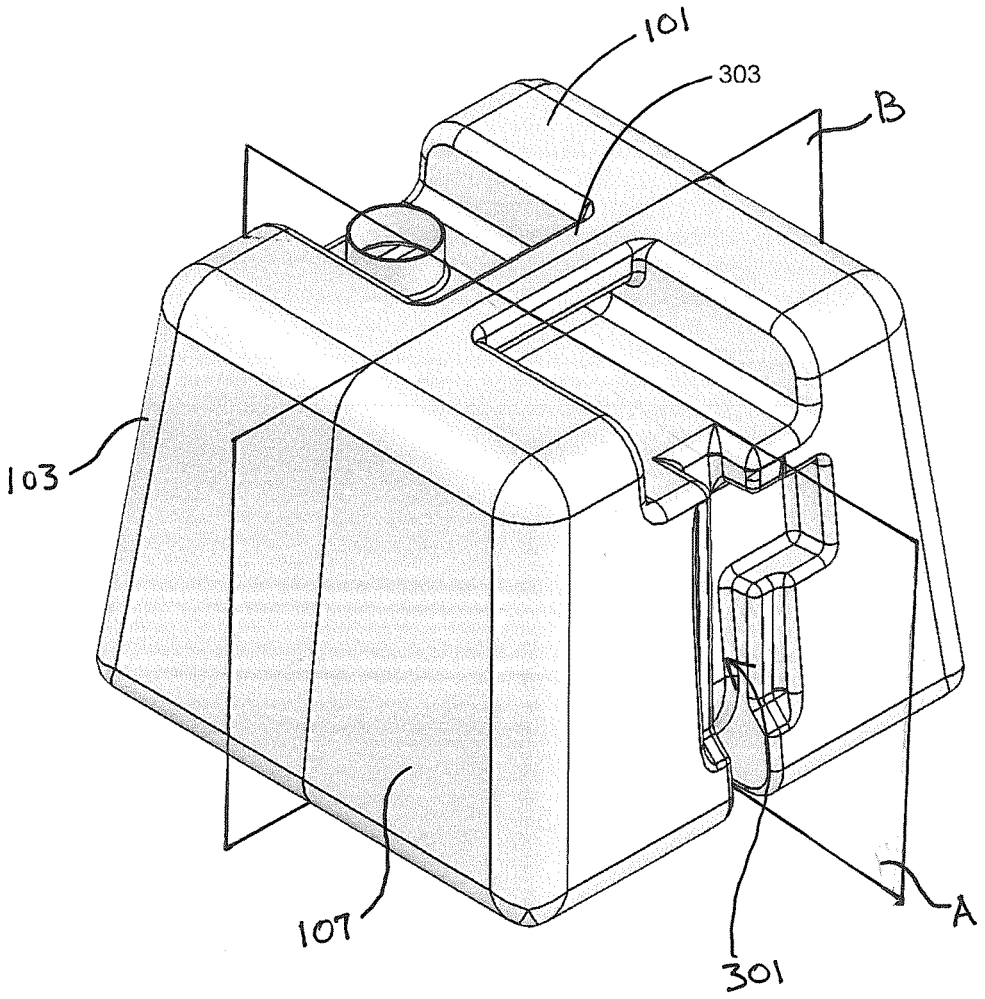
FIG. 3 shows a front top perspective view of the fuel container of the fuel container system of FIG. 1.

FIG. 3 further depicts the fuel container 103 of the fuel container system of FIG. 1 having a handle 303 located on the top section 101. The handle 303 permits a user to position the fuel container system on a desired surface before filling and/or emptying the fluid cavity (shown in FIG. 4). In some embodiments, the handle 303 is formed or molded on the top section 101. In other embodiments, the handle is a separate and distinct component attached to the fuel container 103. Instead, the handle can also be located on the sidewall region 107, or located on and span both the sidewall region 107 and top section 101. Moreover, the handle may comprise more than one structure, as in embodiments where a user grips handle elements on one or more sides of the fuel container using both hands, for example.

In some embodiments, the fuel container 103 further includes a fluid dispenser passage 301 in the sidewall region 107 to retain the fluid dispenser 102 in the stored position. For example, the conduit passage 601 of the base section (shown in FIG. 6) may continue around the bottom edge of the fuel container to form a continuous passageway with the fluid dispenser passage 301 for the fluid dispenser to pass therein. The fluid dispenser passage 301 may be formed or molded into the fuel container 103. In another embodiment, the fluid dispenser passage 301 can be a separate structure attached to fuel container 103. For example, a separate piece forming a fluid dispenser passage 301 can be adhered to the fuel container 103 through the use of adhesive, fastener, welding, friction fit or snap fit connections, or other methods.

Figure 4:
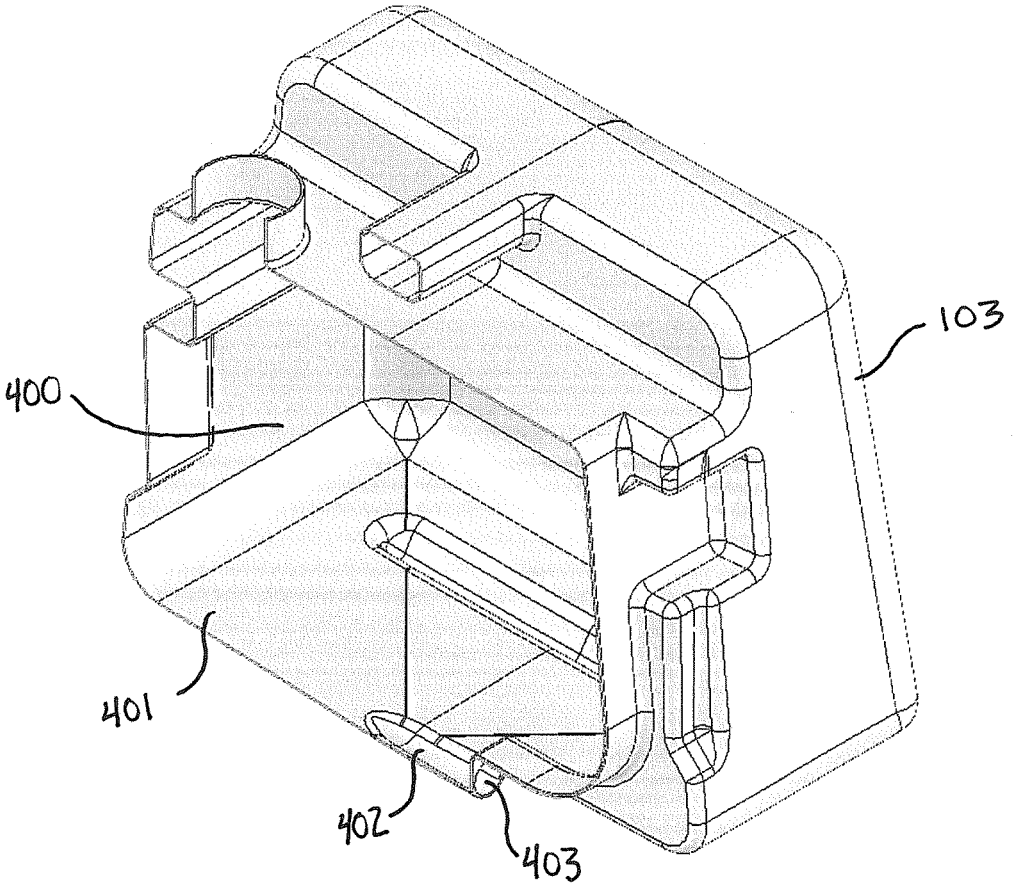
FIG. 4 shows a front top perspective, cross-sectional view of the fuel container of FIG. 3, taken along plane A of FIG. 3.

FIG. 4 shows a cut-away view of the fuel container 103, revealing a fluid cavity 400, taken along plane A-A of FIG. 3. In one embodiment, the fuel container 103 has a base section 401 with a collection channel 402. The collection channel 402 may be recessed with respect the base section 401, thereby creating a lower portion for fluid within the fluid cavity 400 to collect. The base section 401 may have an aperture 403 located at one end of the collection channel 402. The collection channel 402 may have a low end on its terminus where the aperture 403 is located, therein being vertically lower relative to the rest of the fluid cavity 400 such that substantially all the fuel within the fluid cavity 400 is gravitationally drawn toward the aperture 403. The collection channel 402 and the aperture 403 may be located approximately in the center of the base section 401. In other embodiments, the collection channel 402 and the aperture 403 may be located in other locations on the base section 401 and with respect to each other. For example, the collection channel 402 and the aperture may be positioned closer to one side of the sidewall region 107 as compared to an opposite side.

As further depicted in FIG. 4, the collection channel 402 may comprise a semicircular trough formed in the base section 401. Moreover, the collection channel 402 can comprise a semi-spherical depression in the base section 401. In yet other embodiments, the collection channel 402 can comprise other configurations recessed in the base section 401 for fluid inside the fluid cavity 400 to collect and drain toward the aperture 403. Therefore, no limitations are intended by the illustrated embodiment and should not be inferred.

Figure 5:
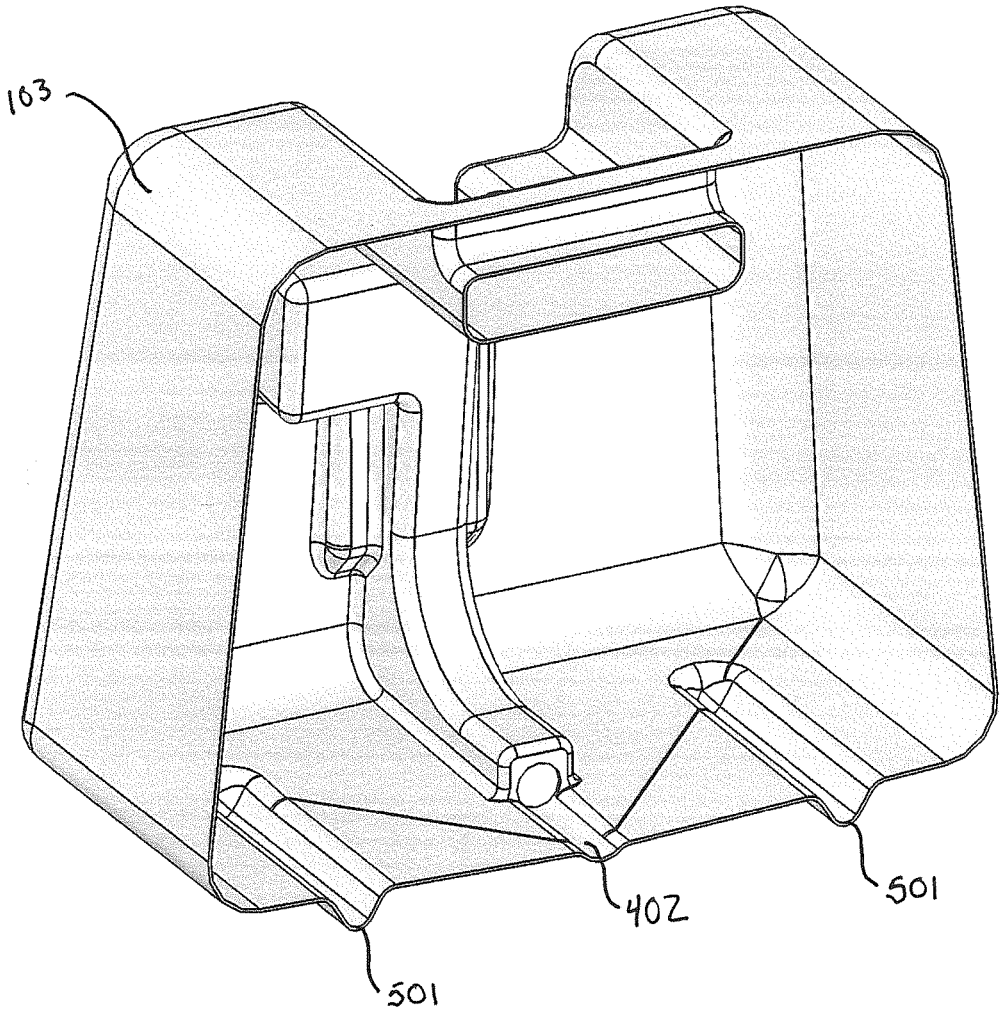
FIG. 5 shows a back top perspective, cross-sectional view of the fuel container of FIG. 3, taken along plane B of FIG. 3.

FIG. 5 shows a cross-sectional view of the fuel container 103 taken along plane B-B of FIG. 3. Certain embodiments of the fuel container system 100 include one or more ground mounts 501. The ground mounts 501 may be formed in the base section 401 of the fuel container 103. For instance, the mounts may be integrally molded thereon. In other embodiments, one or more ground mounts 501 comprise independent structures and be attached to, coupled to, or otherwise configured to support the base section 401 of the fuel container 103. For example, the ground mounts 501 may be formed from plastic, rubber, metal, or other materials and attached to the base section 401 by adhesives, mechanical fasteners, welding, molding, compression or friction connections, or any other suitable connection means. Moreover, a ground mount can be comprised of an independent structure, such as a rack, on which the base section 401 of the fuel container 103 can be placed. The rack can be designed to accommodate the collection channel 402 on an otherwise substantially flat base section 401 lacking ground mounts 501 formed thereon. Accordingly, the fuel container 103 can be freely movable in relation to an independent ground mount 501 structure in certain embodiments.

Figure 6:
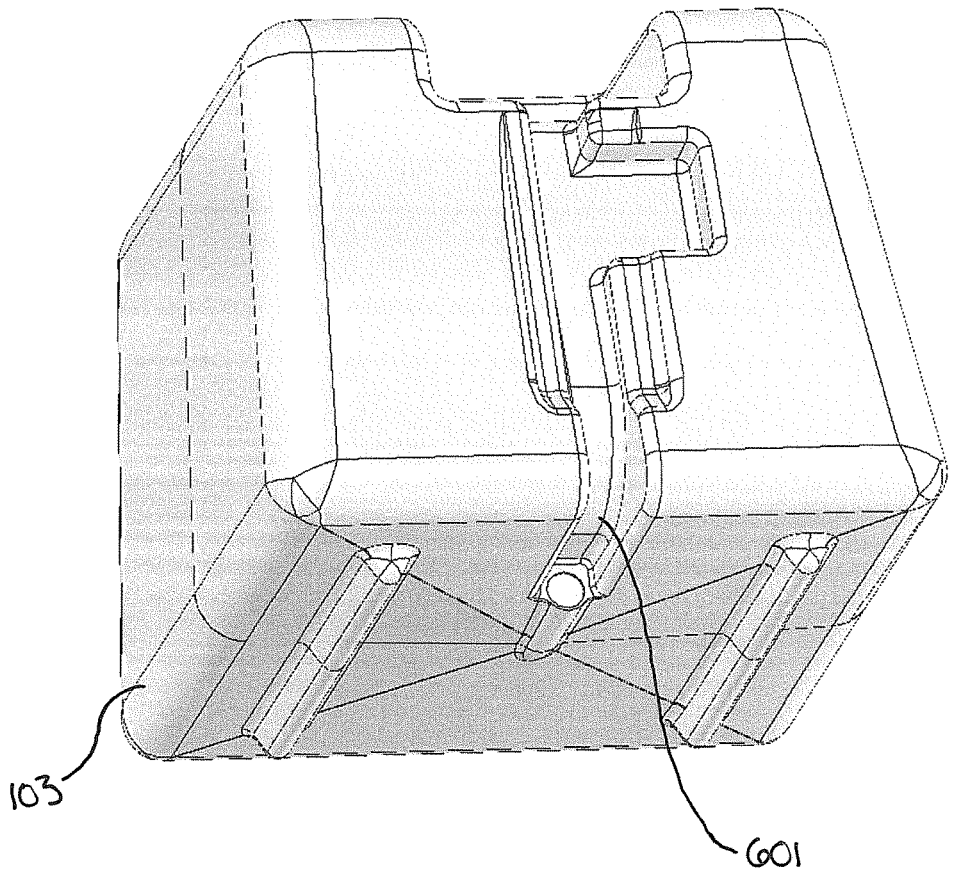
FIG. 6 shows a front bottom perspective view of the fuel container of FIG. 3.

FIG. 6 shows a front bottom perspective view of the fuel container 103. As depicted here, some embodiments of the fuel container system 100 include a conduit passage 601 located on the base section 401. The conduit passage 601 may extend from the aperture 403 to the sidewall region 107. Moreover, the conduit passage 601 may form a recess with respect to the outer portion of the base section 401. In such an embodiment, the conduit passage 601 contains the fluid dispenser 102, as further illustrated by FIG. 7.

Figure 7:
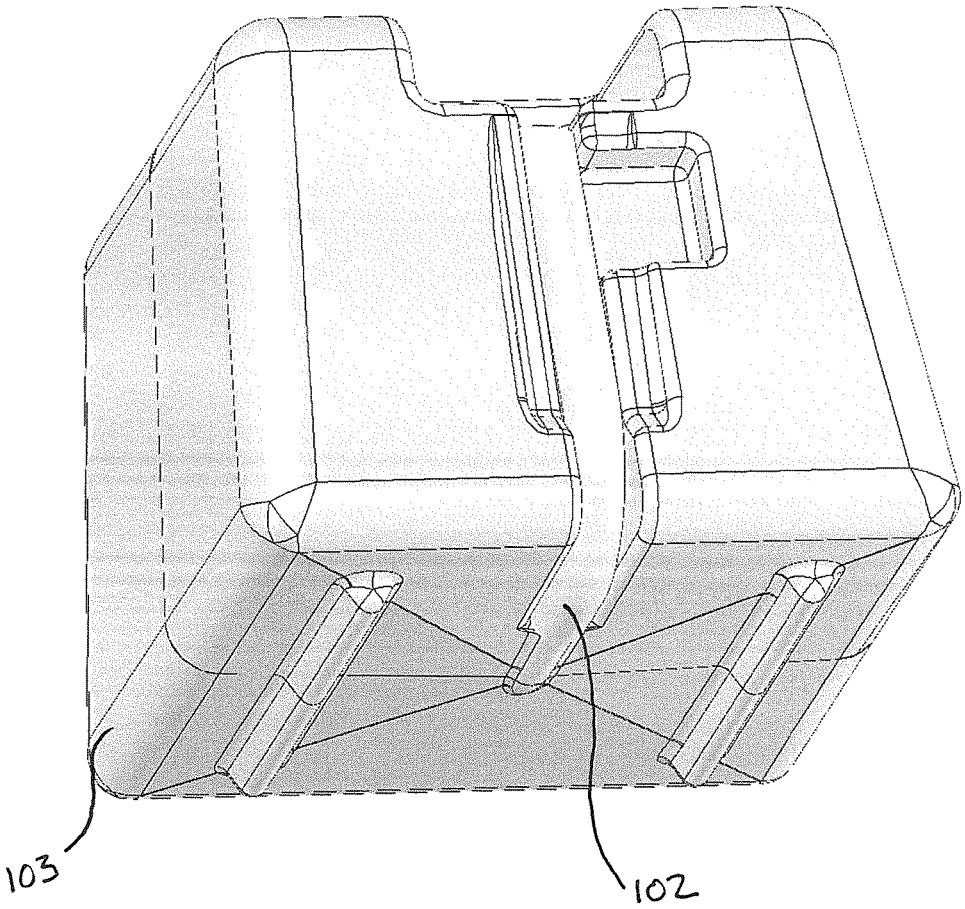
FIG. 7 shows a front bottom perspective view of the fuel container of FIG. 3 with a flexible conduit in a stored configuration.

FIG. 7 shows a front bottom perspective view of the fuel container 103 with the fluid dispenser 102 attached to the aperture 403 and routed through the conduit passage 601. The conduit passage 601 may be configured such that the collection channel 402 and aperture 403 are positioned vertically below the remaining portions of the base section 401. Where ground mounts 501 or analogous structures are present, the base section 401 and the fluid dispenser 102 may remain suspended above the ground in the upright position. For example, when the portable fuel container 103 is resting on a horizontal surface, the ground mounts 501 suspend the base section 401 off the surface. In this configuration, the collection channel 402 and at least a portion of the aperture 403 may be located below the remainder of the base section 401, yet still elevated from the surface. Further, the conduit passage 601 may extend to the sidewall region 107 and connect with the fluid dispenser passage 301. In this embodiment, the fluid dispenser 102 is routed through the conduit passage 601 and secured in the fluid dispenser passage 301 in the stored position.

Figure 8:
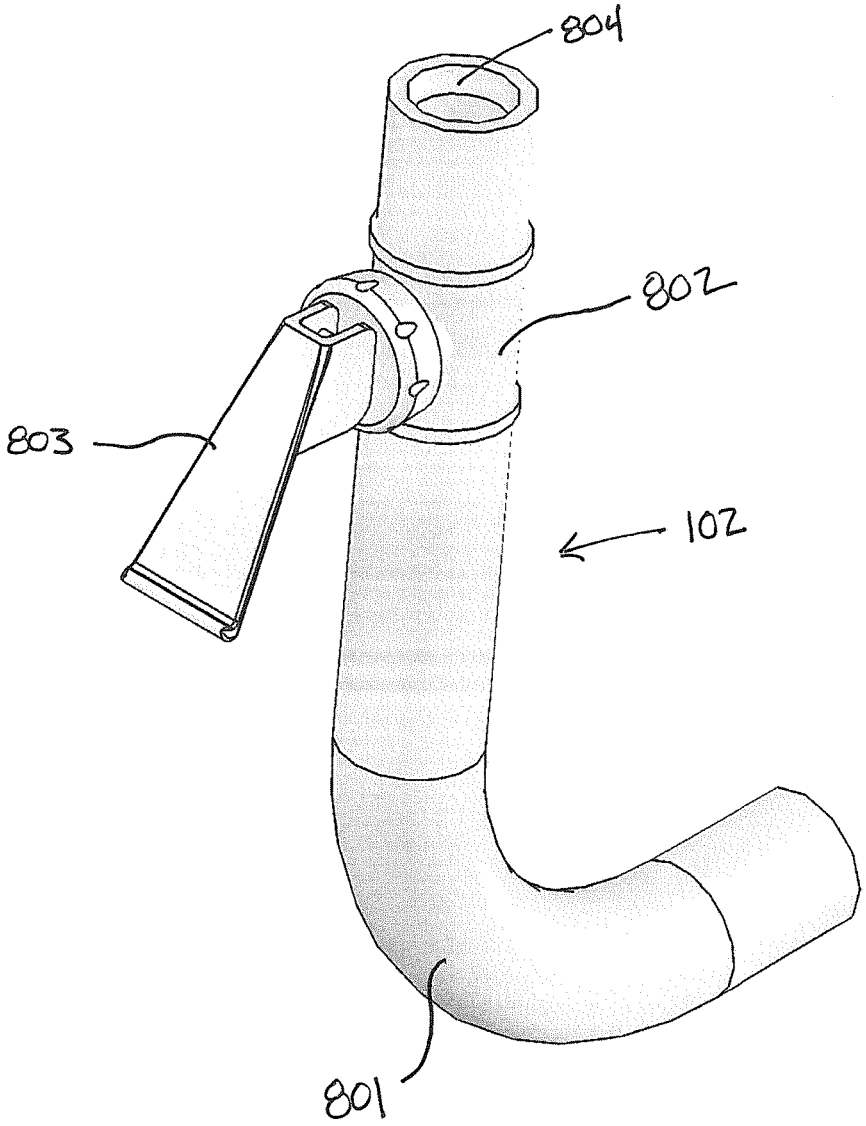
FIG. 8 shows a perspective view of the fluid dispenser of the fuel container system of FIG. 1.

FIG. 8 shows one embodiment of the fluid dispenser 102 of the fuel container system 100. The depicted fluid dispenser 102 comprises a flexible conduit 801, a valve 802, and an outlet opening 804. The flexible conduit 801 is fluidly coupled to the aperture 403. In some embodiments, the flexible conduit 801 is arranged in the conduit passage 601 of the base section 401, and further capable of arrangement in the fluid dispenser passage 301 of the sidewall region 107, such as in the stored position. In the dispensing configuration, the flexible conduit 801 may be disengaged from the dispenser clip 201 and maneuvered out of the fluid dispenser passage 301 and/or the conduit passage 601. Moreover, the valve 802 can be of any suitable type. For example, the valve 802 may be a one-way valve that only permits fluid to flow through the flexible conduit 801 toward the outlet opening 804, and comprise a valve lever 803 to control the flow of fuel. Instead of a lever 803, the valve 802 can alternatively be activated by a button or other suitable means. Due to the maneuverability of the flexible conduit 801, a user can position the outlet opening 804 within the opening of a gas tank for a desired piece of equipment, and then activate the valve lever 803 to open the valve 802 and begin dispensing fuel from the fuel container system 100 to the receiving device.

It should be appreciated that the flexible conduit 801 may be made from plastic or rubber tubing, or any other suitable material which permits the flow of fluid and allows for maneuverability in positioning. In some embodiments, the material of the flexible conduit can be specifically selected to be chemically compatible (i.e., resistant to dissolution or degradation) with certain fluids. Likewise, the valve 802 can also be formed of different materials (e.g., plastics, metals, or other various material combinations), which materials can be selected for chemical compatibility with certain fluids, such as gasoline.

Figure 9:
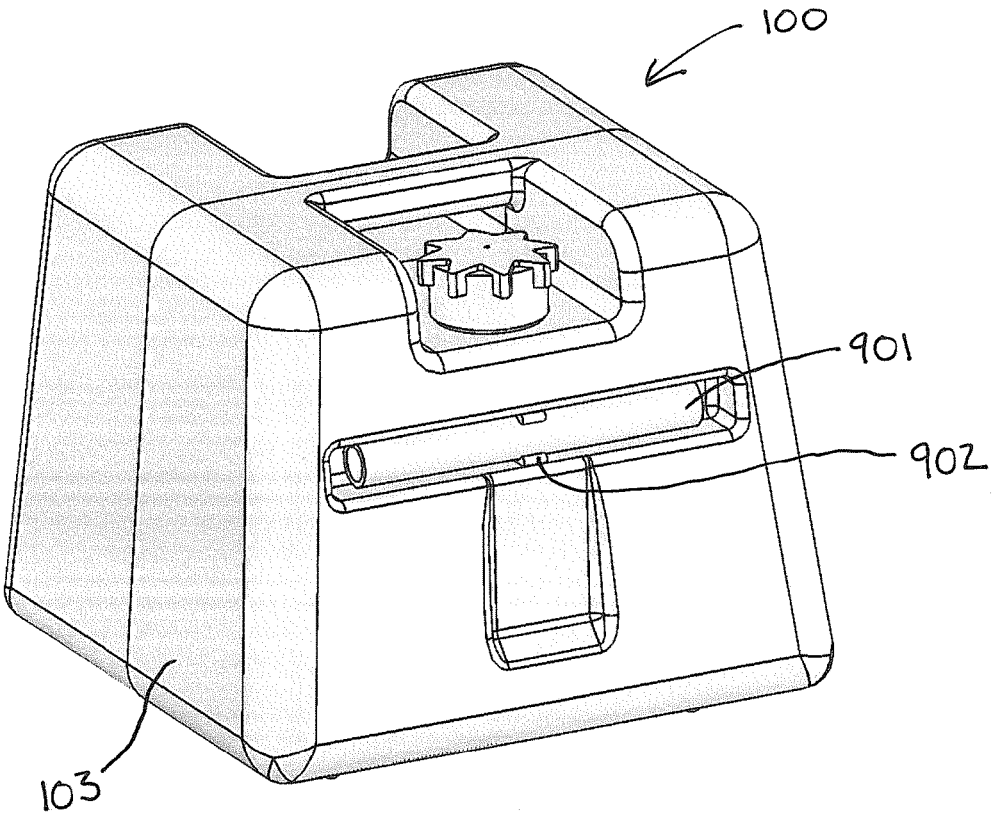
FIG. 9 shows a back top perspective view of the fuel container system of FIG. 1.
Figure 10:
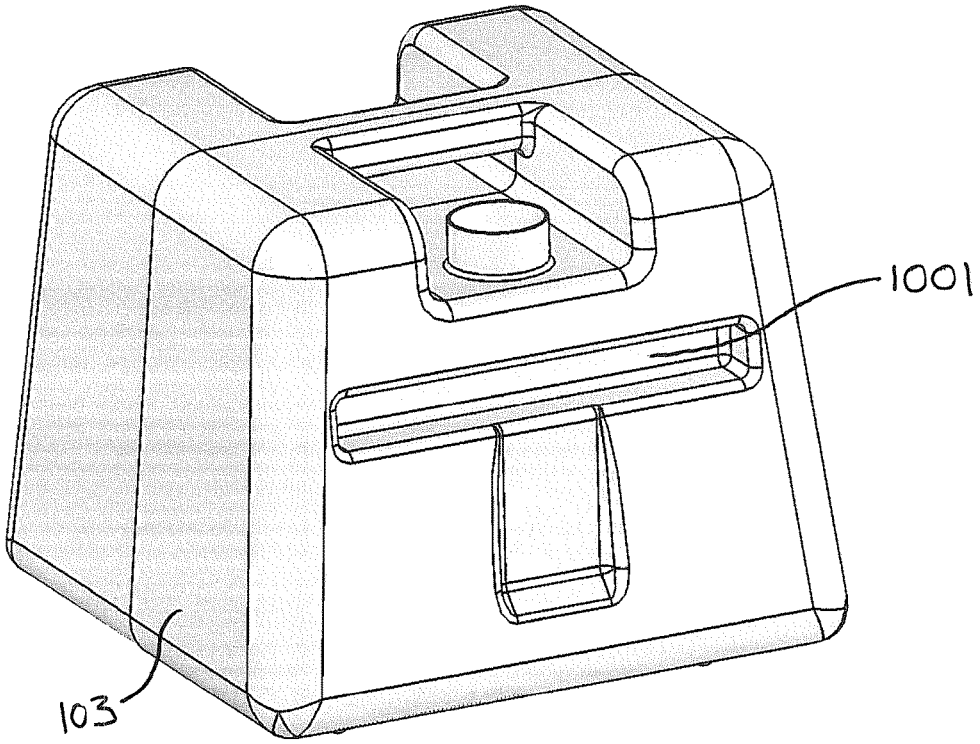
FIG. 10 shows a back top perspective view of the fuel container of FIG. 3.
Figure 11:
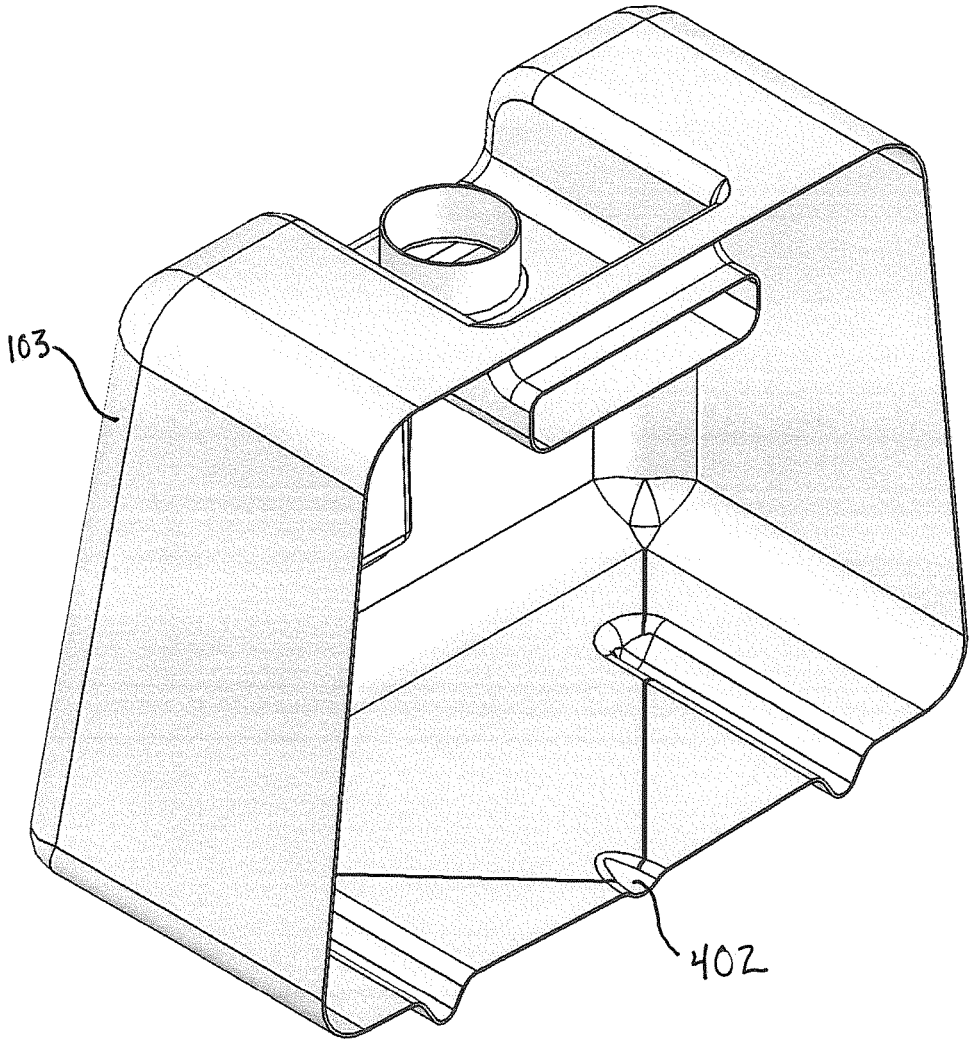
FIG. 11 shows a front top perspective, cross-sectional view of the fuel container of FIG. 3, taken along plane B of FIG. 3.

FIGS. 9 and 10 show a back view of the fuel container 103 and fuel container system 100. The depicted embodiment includes an extension conduit 901 capable of storage in an extender channel 1001 formed into the sidewall region 107 of the fuel container 103. Here, the extension conduit 901 is secured in the extender channel 1001 by an extender clip 902. One skilled in the art will recognize that the extension conduit 901 can be attached through other means, such as by a friction fit. Other embodiments can have different configurations for storing and/or attaching the extension conduit 901 on the fuel container 103. For example, the fuel container can include multiple extender channels and extension conduits. In another embodiment, the extender channel can be a circular cavity, wherein the extension conduit would be coiled or otherwise positioned within the circular cavity. Alternatively, a structure may be formed on or coupled to the exterior of the fuel container, such that the extension conduit can be wrapped around that structure for storage. Additionally, the extender channel can be integrated with the fluid dispenser passage, such that the extension conduit can remain coupled to the fluid dispenser in the stored position. It should be appreciated that the extension conduit can be longer than the illustrated embodiment and, notwithstanding the foregoing, the extension conduit is not necessarily required to attach to the fuel container system at all.

In some embodiments, the extension conduit 901 is flexible and may be made from the same material as the flexible conduit 801, or any other suitable material. The extension conduit 901 is configured to fluidly couple to the fluid dispenser 102 at the outlet opening 804. In another embodiment, the extension conduit 901 is inserted between the flexible conduit 801 and the valve 802. For example, a user can remove the valve 802 from the flexible conduit 801, attach one end of the extension conduit 901 to the flexible conduit 801, and then attach the valve 802 to the other end of the extension conduit 901. By increasing the overall length of the fluid dispenser 102 when integrated thereon, the extension conduit 901 provides an expanded operational zone between the fuel container 103 and the outlet opening 804 for the transfer of fluids in the fuel container system 100.

Embodiments of the fuel container system are generally depicted and described herein in relation to portable containers designed to carry fuel, and specifically gasoline. However, one of skill in the art will appreciate that the concepts of the present disclosure can be applied to containers for other types of fluids as well. Moreover, the disclosed concepts are not limited with respect to either fuel or portability. Accordingly, no limitations regarding the material composition of the fuel container system or the contents stored therein are intended, and should not be inferred.

While a number of aspects and embodiments have been discussed above, persons having ordinary skill in the art will recognize certain modifications, permutations, additions, and equivalents may alternatively be used or introduced. It is intended that the scope of the following claims are interpreted to include all such modifications, permutations, additions, and equivalents. The terms and expressions used herein are for description, not limitation, and there is no intention to exclude any equivalents of the aspects shown and described.

What is claimed is:

1. A fuel container system having a fluid cavity enclosed by a fuel container, the fuel container comprising:

a sidewall region;

a fluid cavity;

a top section comprising a sealable opening configured to receive fuel;

a base section opposite the top section, the base section comprising:

an inner portion of the base section, the inner portion defining at least a portion of the fluid cavity;

a collection channel formed in the base section and recessed downward in a vertical direction in the inner portion of the base section, the collection channel defining at least a portion of the fluid cavity, and configured to gravitationally draw fuel toward a low end of the collection channel when the fuel container is in an upright position, the low end of the collection channel having an aperture, wherein the collection channel has a semicircular cross-section defined by an arc of the aperture; and a conduit passage extending from the aperture to the sidewall region, the conduit passage recessed with respect to an outer portion of the base section, the outer portion facing away from the fluid cavity;

a ground mount supporting the base section in the upright position such that the ground mount spaces the base section from a surface when the ground mount is resting on the surface; and a fluid dispenser comprising:

a flexible conduit fluidly coupled to the aperture, wherein at least a portion of the flexible conduit is positioned within the conduit passage; and a one-way valve to control the flow of fuel through the flexible conduit, such that the fuel flows from the collection channel and through an outlet opening of the flexible conduit only when the one-way valve is open.

2. The fuel container system of claim 1, wherein the collection channel is located substantially in the center of the base section.

3. The fuel container system of claim 2, wherein a portion of the collection channel furthest from the aperture is located substantially in the center of the base section.

4. The fuel container system of claim 1, wherein the collection channel comprises a high end opposite the low end.

5. The fuel container system of claim 1, wherein the sidewall region comprises a fluid dispenser passage to receive the fluid dispenser.

6. The fuel container system of claim 5, further comprising a dispenser holder that secures the fluid dispenser in a stored position in the fluid dispenser passage.

7. The fuel container system of claim 1, wherein the fuel container generally tapers from the base section to the top section.

8. The fuel container system of claim 1, wherein the fuel container is a substantially trapezoidal prism shape.

9. The fuel container system of claim 1, wherein the ground mount is molded into the base section.

10. The fuel container system of claim 1, wherein the ground mount comprises at least two feet.

11. The fuel container system of claim 1, wherein a handle is molded into the top section.

12. The fuel container system of claim 1, wherein the sealable opening comprises a spout and a removable cap.

13. The fuel container system of claim 12, wherein the removable cap is configured to engage the spout by turning the removable cap relative to the spout.

14. The fuel container system of claim 1, wherein the one-way valve comprises a control lever configured to open the one-way valve when pressed and to close the one-way valve when released.

15. The fuel container system of claim 1, wherein the fluid dispenser further comprises an extension conduit, the extension conduit configured to fluidly couple to the flexible conduit at the outlet opening.

16. The fuel container system of claim 15, wherein the sidewall region comprises an extender channel, the extender channel configured to receive the extension conduit for storage.

17. The fuel container system of claim 1, wherein an extender channel is formed on the sidewall region facing away from the fluid cavity.

18. The fuel container system of claim 1, wherein the fuel container is a substantially rectangular prism shape.

* * * * *